US008708842B2

(12) United States Patent
Ganuza

(10) Patent No.: US 8,708,842 B2
(45) Date of Patent: Apr. 29, 2014

(54) SOCCER TRAINING APPARATUS

(75) Inventor: Wilfredo Ganuza, Roselle, NJ (US)

(73) Assignee: Eden Variety Products, LLC, Roselle, NJ (US)

( * ) Notice: Subject to any disclaimer, the term of this patent is extended or adjusted under 35 U.S.C. 154(b) by 0 days.

(21) Appl. No.: 13/251,695

(22) Filed: Oct. 3, 2011

(65) Prior Publication Data

US 2012/0083368 A1 Apr. 5, 2012

Related U.S. Application Data

(60) Provisional application No. 61/389,365, filed on Oct. 4, 2010.

(51) Int. Cl.
*A63B 69/00* (2006.01)

(52) U.S. Cl.
USPC ..... 473/446; 473/422; 482/51

(58) Field of Classification Search
USPC ..... 473/422, 423, 427, 430, 438, 446; 482/54, 69, 74; 124/16; 434/247, 251
See application file for complete search history.

(56) References Cited

U.S. PATENT DOCUMENTS

| | | | | |
|---|---|---|---|---|
| 1,016,729 | A * | 2/1912 | Barrett | 482/54 |
| 4,534,557 | A * | 8/1985 | Bigelow et al. | 473/442 |
| 4,641,834 | A | 2/1987 | Hegedus | |
| 4,883,271 | A * | 11/1989 | French | 482/84 |
| 4,890,495 | A * | 1/1990 | Slane | 482/51 |
| 5,176,597 | A * | 1/1993 | Bryne | 482/74 |
| 5,435,572 | A * | 7/1995 | Covel | 473/423 |
| 5,556,106 | A | 9/1996 | Jurcisin | |
| 5,660,550 | A | 8/1997 | Roche | |
| 5,873,798 | A | 2/1999 | Bostick | |
| 6,000,944 | A * | 12/1999 | Schiefer | 473/430 |
| 6,093,119 | A | 7/2000 | Tipton | |
| 6,123,649 | A * | 9/2000 | Lee et al. | 482/54 |
| 6,146,315 | A * | 11/2000 | Schonenberger | 482/69 |
| 6,151,563 | A * | 11/2000 | Marinelli | 702/141 |
| 6,220,974 | B1 * | 4/2001 | Moore | 473/430 |
| 6,475,108 | B1 | 11/2002 | Sarenana | |
| 6,575,879 | B1 | 6/2003 | Harney | |
| 6,715,477 | B1 * | 4/2004 | Gilman | 124/16 |
| 6,837,830 | B2 * | 1/2005 | Eldridge | 482/54 |
| 7,066,846 | B2 | 6/2006 | Horkan | |
| 7,137,909 | B2 | 11/2006 | Ohle | |

(Continued)

FOREIGN PATENT DOCUMENTS

| | | |
|---|---|---|
| EP | 2016981 | 1/2009 |
| EP | 2025369 | 2/2009 |
| GB | WO03033082 | 4/2003 |
| IT | WO0152952 | 7/2001 |

*Primary Examiner* — Mitra Aryanpour
(74) *Attorney, Agent, or Firm* — Gearhart Law, LLC

(57) ABSTRACT

An elegantly simple training apparatus that helps soccer players quantify, and improve, their kicking skills. The soccer training apparatus includes a cage having a base, and at least one hand railing connected to the base. The base has a front portion and a rear portion with a ball moveably affixed, or tethered, to the front portion of the base by an attachment mechanism. The attachment mechanism may include, or be connected to, a force measuring mechanism that measures the force exerted on the ball after a user kicks the ball. The soccer training apparatus may also include a force display unit that displays that force to the user. The hand railing may extend over the base rear portion and may have a resistance band attached, that may exert a force on a user's kicking foot during a kick.

5 Claims, 4 Drawing Sheets

(56) References Cited

U.S. PATENT DOCUMENTS

| | | | | |
|---|---|---|---|---|
| 7,513,852 | B2 | 4/2009 | Wilkins | |
| 7,645,212 | B2 | 1/2010 | Ashby | |
| 2012/0083368 | A1* | 4/2012 | Ganuza | 473/446 |
| 2012/0295769 | A1* | 11/2012 | Pennington | 482/54 |

* cited by examiner

SOCCER TRAINING APPARATUS

CLAIM OF PRIORITY

This application claims the priority of U.S. Ser. No. 61/389,365 filed on Oct. 4, 2010, the contents of which are fully incorporated herein by reference.

FIELD OF THE INVENTION

The invention relates to a sports training devices and, more particularly, to a soccer-kick training apparatus.

BACKGROUND OF THE INVENTION

The evolution of sports training devices continues in the direction of ever greater specialization. They are being designed for more different, but very specific, athletic activities and tend to aim at developing skills, and muscular development, particular to a single given area of endeavor. The present invention follows this trend, being a training aid designed to provide soccer players with kicking practice.

In the sport of soccer, kicking a ball well requires a great deal of practice. A complication to this needed practicing of kicking is that when a ball is kicked, it is projected away from the kicker, who must then retrieve the ball to practice a subsequent kick. In the absence of cooperative assistants, this may become a time consuming, tedious and unproductively tiring aspect of the practice.

In soccer there is also the problem of not being able to simply, quickly and accurately quantify kicking ability. Such quantification would allow managers, coaches and players to quickly judge the relative kicking ability of different players, and to evaluate the improvement of a player over time. It would also allow them to assess the effectiveness of different training techniques or regimes.

The relevant prior art involving soccer kick training aids includes:

U.S. Pat. No. 7,137,909 titled "Soccer kicking training apparatus" filed on Nov. 21, 2006 describes a soccer kicking practice apparatus that is provided with an elongated soccer ball mounting arm comprised of a center shaft in the form of a roller chain positioned inside of a coil spring and a coil spring compression decompression device. An outside end of the elongated soccer ball mounting arm is provided with a soccer ball mounting device. An inside end of the soccer ball mounting arm is provided with a connector that serves to hold the mounting arm at a desired elevation. The center shaft and coil spring create a biasing system that returns the soccer ball to its original position after it has been kicked.

U.S. Pat. No. 6,475,108 entitled "Soccer kicking training device" filed on Nov. 5, 2002 describes a soccer kicking training device used for placement on a surface and for allowing a soccer ball to be kicked thereof. The soccer ball kicking training device includes a base with stationary base connector and horizontal and vertical members, two ball holder means, a height adjustment means, and a ball. The base is supported by a surface in a horizontal plane with weighted material used to help stabilize the device. The stationary base connector is attached to the base and provides height adjustment. A vertical member and horizontal member slides freely inside the stationary base connector, which provides further height adjustments to the soccer kicking training device. A top and side ball holder by which a ball can be mounted and/or attached, by which a player standing on a surface can kick a stationary ball. The soccer kicking training device has quick setup and is easily transportable to and from the soccer field.

The present invention teaches basic soccer principals used in kicking side volleys and front volleys into the goal.

U.S. Pat. No. 6,220,974 entitled "Training device for kicking soccer balls" describes a ball kicking apparatus suitable for (1) practicing kicking a soccer-type ball; (2) training to be a goal keeper to receive a ball; and (3) obtaining aerobic exercise, where a frame has two upstanding members for supporting a soccer-type ball by a first cord to be kicked and a second cord for controlling the path of the kicked ball. A netted bag for holding the soccer-type ball can be used and arms can connect the frame to a wall for positioning and storing on the wall.

U.S. Pat. No. 5,660,550 entitled "Soccer kick training device" describes a soccer kicking practice device. The device has a movable platform or running surface, such as a motorized treadmill, for forcing the user to run while practicing, and a movable kick target, both the movable platform and movable target mounted on a stationary base. Preferably, the practice device has a hand rail and a body harness for steadying and retaining the user. Elevating apparatus enables the practice device to elevate its front end or its rear end, to simulate uphill and downhill inclination of terrain. Controls enable speed of the treadmill and of the kick target to be adjusted, and the elevating apparatus to operate as desired. Optionally, the treadmill is lined with artificial turf. Automated scoring apparatus is optionally provided for recording and totalizing the number of kicks.

Various implements are known in the art, but fail to address all of the problems solved by the invention described herein. One embodiment of this invention is illustrated in the accompanying drawings and will be described in more detail herein below.

SUMMARY OF THE INVENTION

The present invention is an elegantly simple soccer training apparatus that allows players to both quantify and improve their kicking skills.

In a preferred embodiment the soccer training apparatus includes a cage that has a base and at least one hand railing connected to that base. The base has a front portion and a rear portion, with a ball moveably affixed, or tethered, to the front portion of the base by an attachment mechanism. The attachment mechanism may include, or be connected to, a force measuring mechanism that measures the force exerted on the ball after a user kicks the ball. The soccer training apparatus may also include a force display unit that displays that measured force to the user.

In a preferred embodiment of the soccer training apparatus, the hand railing may extend over the base rear portion and the hand railing may have a resistance band attached to it. The resistance band, when attached to the user's foot, may exert a force on the user's kicking foot during a kick.

Therefore, the present invention succeeds in conferring the following, and others not mentioned, desirable and useful benefits and objectives.

It is an object of the present invention to provide a simple device that allows soccer players to improve their kicking skills through practice, without the need for willing assistants, or the player themselves, to be constantly retrieving balls.

It is another object of the present invention to provide a convenient device for strengthening the muscles used in kicking a ball.

Yet another object of the present invention is to provide instant feedback regarding the effectiveness of a user's kicking technique, enabling the user to more rapidly improve.

Still another object of the present invention is to provide a simple, quick and reliable means of measuring the strength of a user's kick either for comparison with other players or to track a user's improvement over time.

DESCRIPTION OF THE PREFERRED EMBODIMENTS

Figure 1:
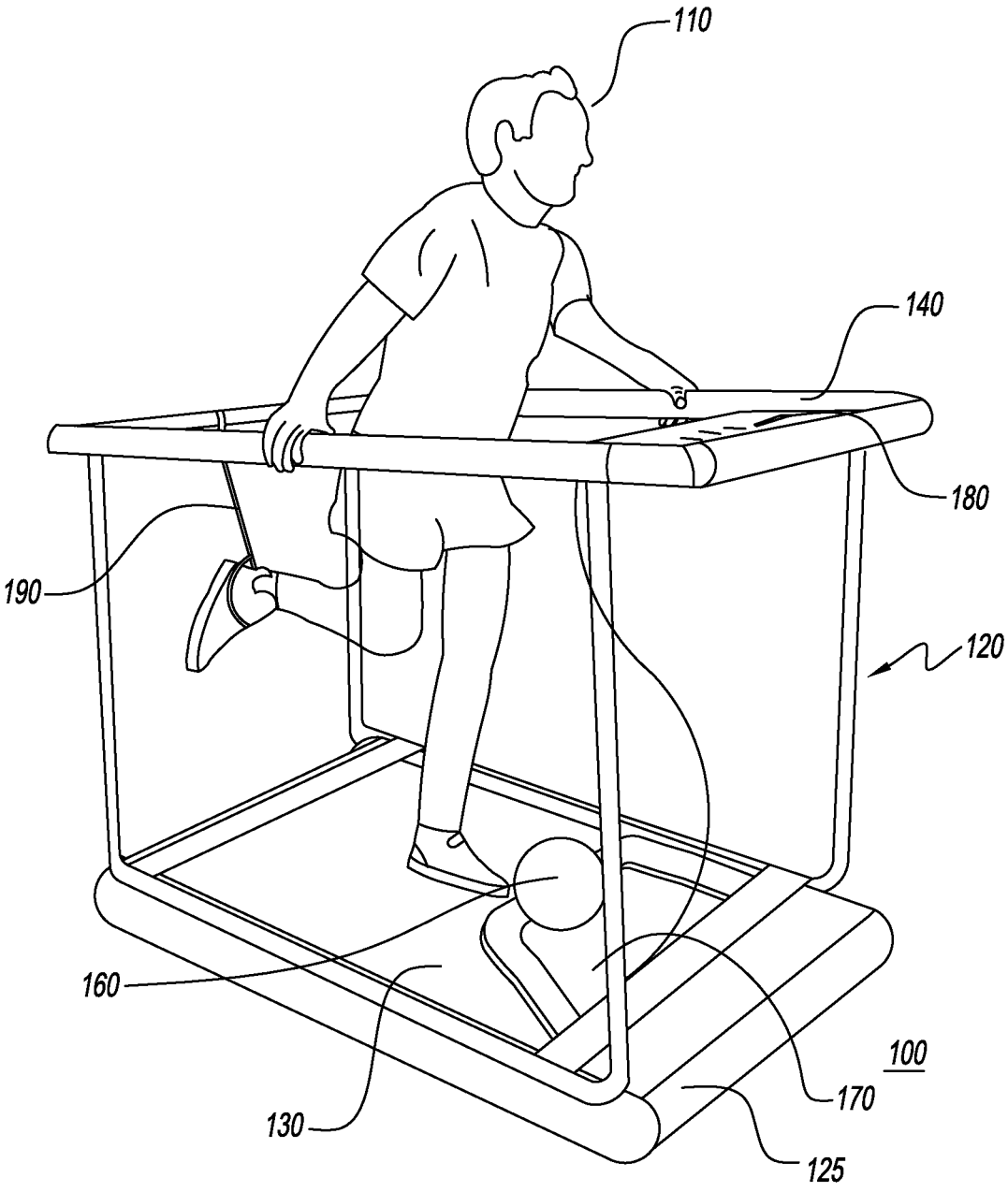
FIG. 1 shows an perspective view of the preferred embodiment of a soccer training apparatus of the present invention, demonstrating the use of the soccer training apparatus.

The present invention provides a simple, elegant and convenient device that allows soccer players to improve their kicking skills through practice, and to strengthen the muscles used in kicking a ball, without the need for willing assistants, or the player themselves, to be constantly retrieving balls.

In addition, the soccer training apparatus of this invention provides a simple, quick and reliable means of measuring the strength of a user's kick. This data may provide instant feedback to the player regarding the effectiveness of their kicking technique, allowing them to quickly make adjustments and refine their kicking skills. This data may also be used to compare different players' kicking abilities and to track improvements to an individual player's kicking ability over time.

The preferred embodiments of the present invention will now be described with reference to the drawings. Identical elements in the various figures are identified with the same reference numerals.

Reference will now be made in detail to embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1 shows an perspective view of the preferred embodiment of a soccer training device of the present invention, demonstrating the use of the soccer training apparatus 100.

The soccer training apparatus 100 has a cage 120 with a base 130 and a hand railing 140. The base 130 may include a treadmill 125. A ball 160 may be flexibly or movably tethered or attached to the front portion of the base 130 by means of an attachment mechanism 150. The soccer training apparatus 100 may also have a force measuring mechanism 170 that may measure the force a user 110 imparts to the ball 160 when kicking it. The soccer training apparatus 100 may also have a force display unit 180 that displays the measured force to the user 110.

A user 110 may practice kicking the ball, as shown in FIG. 1, in order to improve their technique or to build up the strength in their kicking muscles. They may do this by simply standing on the base 130 and kicking the ball 160. Seeing the force they managed to impart to the ball displayed on the force display unit 180 may provide them with instant feedback regarding their progress. This feed-back may, for instance, allow the user to make adjustments to their kicking technique means such as, but not limited to, altering their foot placement, reducing or increasing the amount of the back swing of their kicking foot, or the angle with which their foot strikes the ball, or some combination thereof.

In an embodiment incorporating a treadmill 125, the user 110 may elect to operate the treadmill at a constant or variable speed to simulate either the act of kicking a ball while running, or running from a stationary start to kick a ball.

In a preferred embodiment, the soccer training apparatus 100 may have a resistance band 190 attached to a portion of the hand railing 140 that extends over a rear portion of the base 130. As shown in FIG. 1, the resistance band 190 may be attached to the foot or ankle of the user 110. In such a configuration, the resistance band 190 may exert a retarding force on the leg of the user 110 when they attempt to kick the ball 160. This retarding force may be beneficial in developing the user's 110 leg strength or kicking power.

The resistance band 190 may be made of a suitably extendable material such as, but not limited to, elastic, rubber, a metallic or plastic spring or a synthetic polymer having appropriate strength and modulus of elasticity, or some combination thereof. Although the resistance band 190 is shown attached to the hand railing 140, one of ordinary skill in the art will readily appreciate that alternative embodiments of the cage 120 may include devices for adjusting the point of connection of the resistance band 190. There may, for instance, be cross-bar that is slidably connected to the rear uprights of the cage 120 and that is curved outward so as not to impede the user 110's kicking. Such a cross-bar may be fixed in position at any height between the base 130 and the hand railing 140, and may be used to attach the resistance band 190 at that height.

At the unattached end of the resistance band 190 there may be an attachment device 200. The attachment device 200 may be a simple loop, or it may be a more sophisticated arrangement such as, but not limited to, a fastenable strap, a portion of a shoe, or a clip on attachment or some combination thereof.

Figure 2:
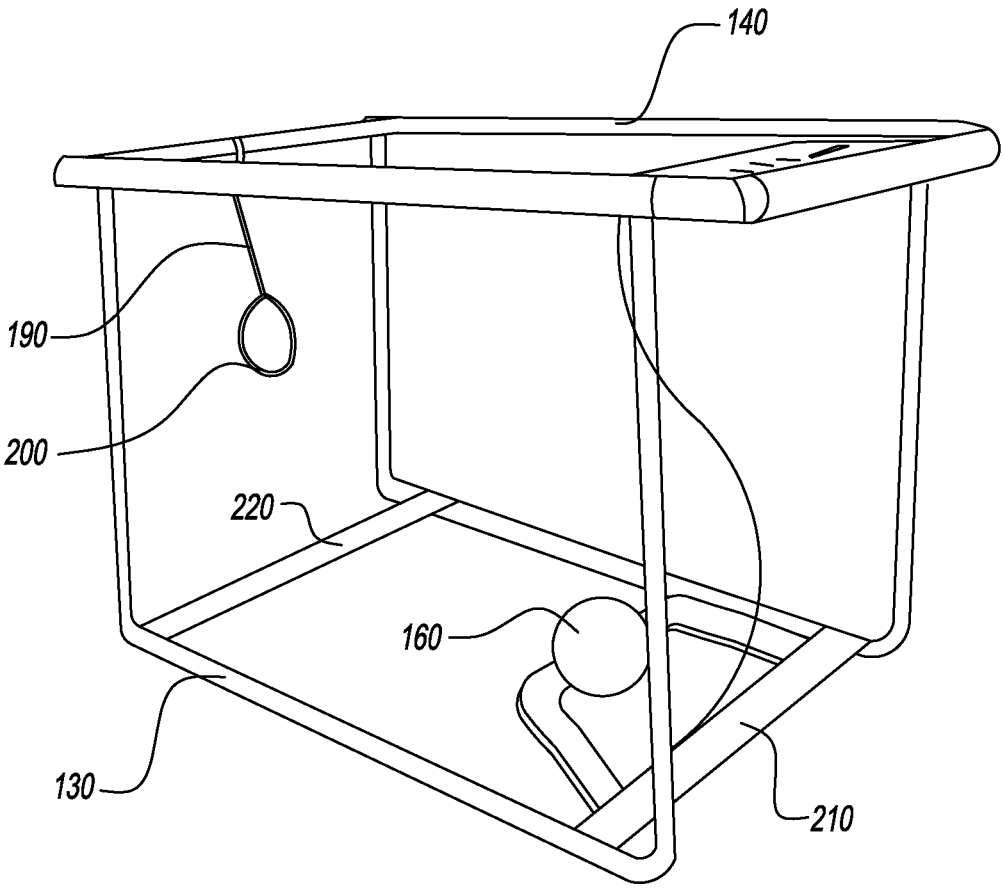
FIG. 2 shows a further perspective view of the preferred embodiment of the soccer training apparatus.

FIG. 2 shows a further perspective view of the preferred embodiment of the soccer training apparatus 100. The base 130 of the soccer training apparatus 100 may have a front portion 210 to which the ball 160 may be attached, and a rear portion 220 that may be for stabilization of the cage 120.

Figure 3:
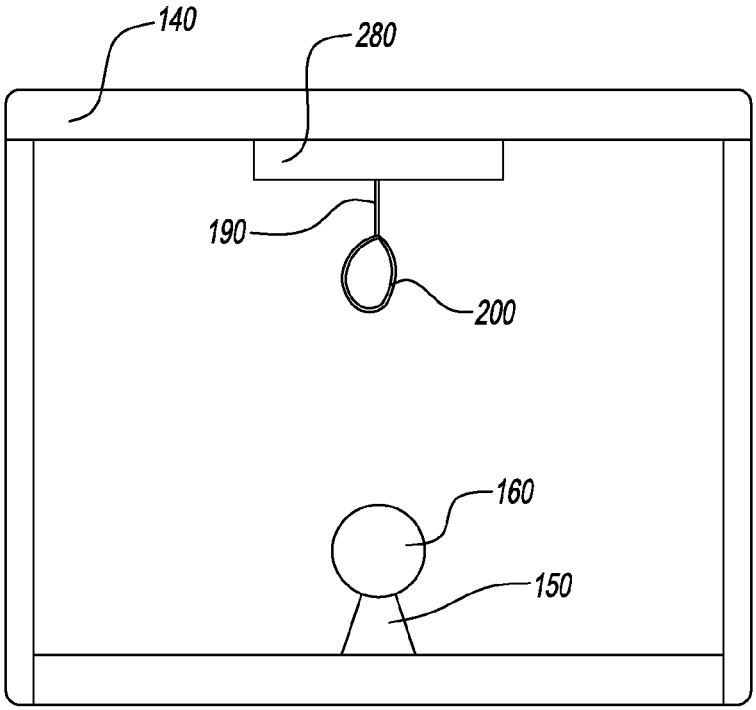
FIG. 3 shows a front view of the preferred embodiment.

FIG. 3 shows a front view of the preferred embodiment of the soccer training device 100. A user console 280 is shown behind the hand railing 140 of the cage 120. FIG. 3 also shows the ball 160 attached to the top of an attachment mechanism 150.

Figure 4:
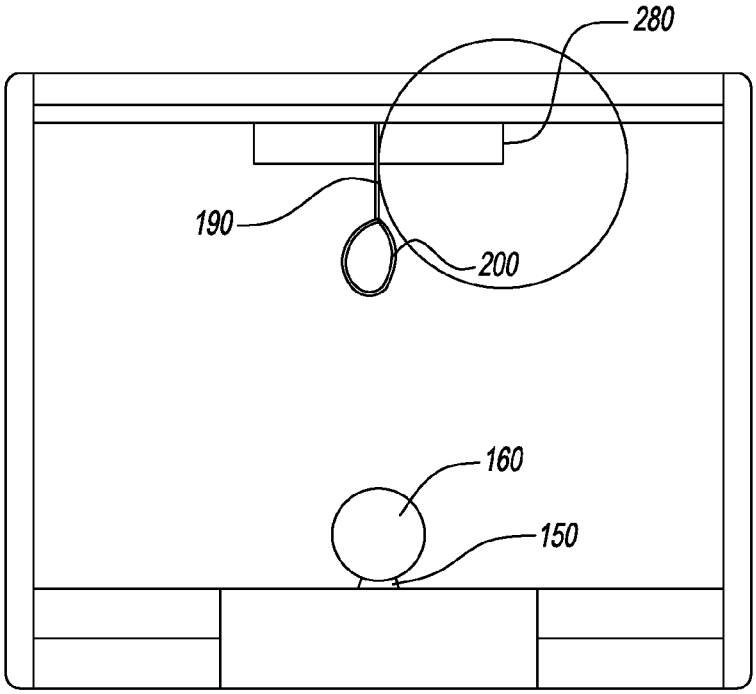
FIG. 4 shows a rear view of the preferred embodiment.

FIG. 4 shows a rear view shows a front view of the preferred embodiment of the soccer training device 100. The resistance band 190 with the attached attachment device 200 is shown in front of the user console 280. The ball 160 is also shown on top of the attachment mechanism 150.

Figure 5:
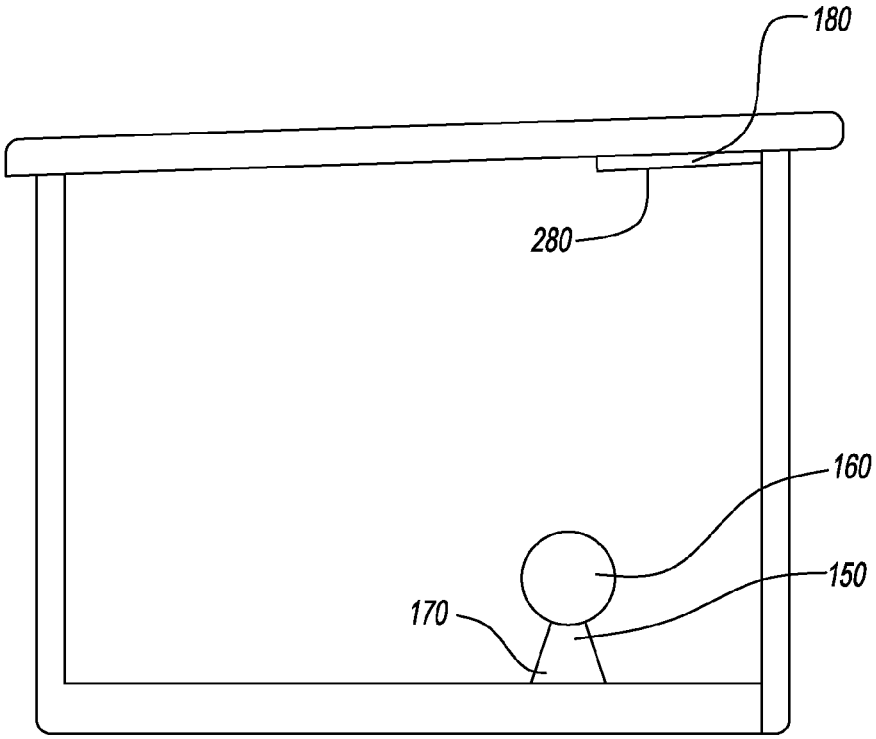
FIG. 5 shows a side view of the preferred embodiment.

FIG. 5 shows a side view of the preferred embodiment of the soccer training apparatus 100. The user console 280 is shown containing the force display unit 180.

In a preferred embodiment of the invention, the ball 160 is preferably a soccer ball, though any suitable object for kicking may be substituted for the ball 160 including, but not limited to, a solid sphere made of a suitable material such as, but not limited to, plastic, plastic foam, leather, felt, rubber or some combination thereof. The ball 160 may also be cylindrical or oblate in shape.

The attachment mechanism 150 that movably connects the ball 160 to the front portion 210 of the base 130 may for instance include one or more springs. The attachment mechanism 150 may, for instance, have a spring loaded sliding mechanism that allows the kicked ball to travel a short distance in one direction.

The attachment mechanism 150 may incorporate the force measuring mechanism 170. The force measuring mechanism 170 may be a device such as, but not limited to, a strain gauge, a MEMS accelerometer, a piezoelectric crystal or a fiber optic strain gauge, or some combination thereof.

Figure 6:
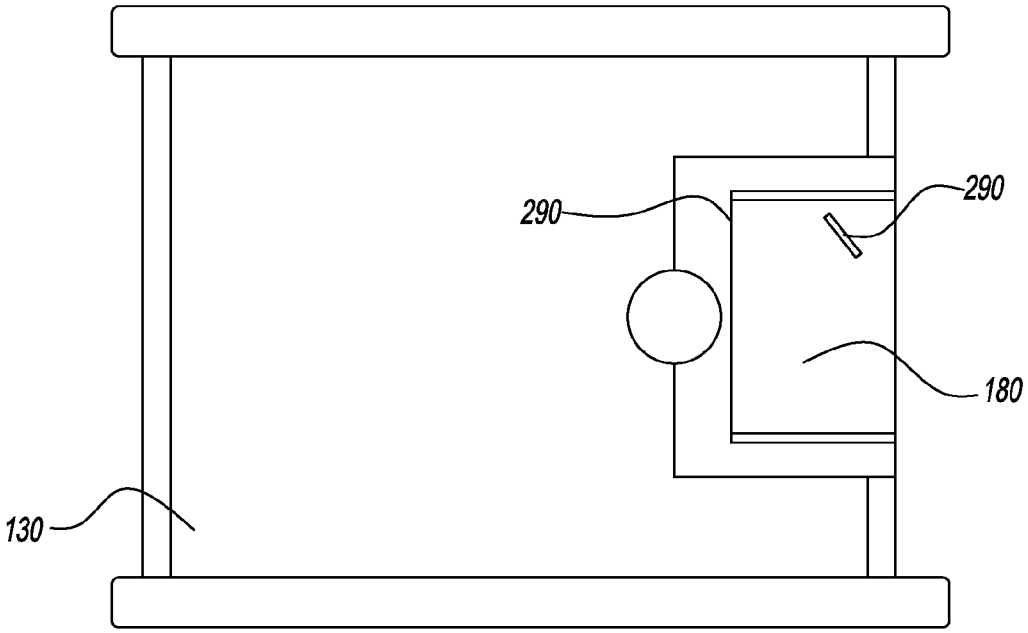
FIG. 6 shows a top view of the preferred embodiment.

FIG. 6 shows a top view of the preferred embodiment of the soccer training apparatus 100.

The base 130 of the soccer training apparatus 100 may be covered with a suitable non-slip surface that may also, or instead, provide a reasonable simulation of a real soccer playing surface. Such surfaces may include, but are not limited to, artificial turf, carpeting, non-slip rubber matting or some combination thereof.

The force measured by the force measuring mechanism 170 may be transmitted to a force display unit 180 mounted on the user console 280 for the user 110 to see or hear. The force display unit 180 may be any well known displays including, but not limited to, a Light Emitting Diode (LED) display, an Organic Light Emitting Diode (OLED) display, a Liquid Crystal Display (LCD) or some combination thereof. The measured force may also, or instead, be communicated to the user audibly, using suitable speaker or headphones. Transmission of the data concerning the force may be transmitted from the force measuring mechanism 170 to the force display unit 180 by any suitable means such as, but not limited to, electrically conducting wire, fiber optic cable or by wireless means such as Blue Tooth, WiFi or wireless telephone connection, or some combination thereof.

In an alternative embodiment of the invention, the ball itself may contain the force measuring mechanism 170 in the form of, for instance, one or more Micro-Electro-Mechanical Systems (MEMS) accelerometers, as used in smart phones, and the appropriate technology to wirelessly transmit the data obtained from the accelerometers to the force display unit 180. In such an embodiment, the ball 160 may not need to be tethered to the base 130 but may instead be tee-ed up on a holder and be kicked into a suitably sized capture net or a capture container.

In addition to measuring the force imparted to the ball 160 a user 110 kicking it, the force measuring mechanism 170 may have additional force or motion sensors to enable it to measure or calculate other attributes of the kick such as, but not limited to, a speed the ball would have travelled had it not been tethered, a distance the ball would have travelled had it not been tethered, the spin imparted to the ball, the trajectory the ball would have taken had it not been tethered, or some combination thereof.

The user console 280 may also incorporate a portable electronic device holder 290 such as, but not limited to, an iPod™ holder, a charging, powering or connection device for a smart phone such as, but not limited to, an iPhone™ or an Android™ operated phone.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed:

1. A soccer training device, consisting essentially of: a cage, said cage being formed of four vertical rails, said vertical rails being connected from their upper ends with two horizontal side rails, a horizontal back rail and a horizontal front rail where said side rails, back rail and front rail form a substantially square shaped formation, said vertical rails being also connected from their lower ends with two parallel horizontal rails;

the two parallel horizontal rails being attached together with a horizontal front portion and a horizontal rear portion;

a ball, affixed to the front portion by an attachment mechanism allowing the ball to travel a short distance to one direction when kicked;

a force measuring mechanism that measures the force exerted on the ball after a user kicks the ball, and a force display unit that displays that force to the user; and a downward hanging resistant band attached to the horizontal back rail, said resistant band forming a substantially O-shaped ankle loop.

2. The device of claim 1, wherein the ball is a soccer ball.

3. The device of claim 1, wherein the ball is affixed to the front portion with a spring.

4. The device of claim 1, wherein the force display is a digital readout.

5. A method to train soccer, said method comprising the steps of:

a) providing a soccer training device comprising:

a cage, said cage being formed of four vertical rails, said vertical rails being connected from their upper ends with two horizontal side rails, a horizontal back rail and a horizontal front rail where said side rails, back rail and front rail form a substantially square shaped formation, said vertical rails being also connected from their lower ends with two parallel horizontal rails;

the two parallel horizontal rails being attached together with a horizontal front portion and a horizontal rear portion;

a ball, affixed to the front portion by an attachment mechanism allowing the ball to travel a short distance to one direction when kicked;

a force measuring mechanism that measures the force exerted on the ball after a user kicks the ball, and a force display unit that displays that force to the user; and a downward hanging resistant band attached to the horizontal back rail, said resistant band forming a substantially O-shaped ankle loop;

b) a user standing inside the cage and attaching his/her ankle into the ankle loop;

c) the user kicking the ball;

d) the force measuring mechanism measuring force that the user used when kicking the ball;

e) the force display unit showing the measured force; and f) the user adjusting his kicking technique and kicking the ball again.

* * * * *